US005330806A

United States Patent [19]

Bythewood et al.

[11] Patent Number: 5,330,806

[45] Date of Patent: Jul. 19, 1994

[54] PUZZLE TOWEL/MAT FOR BATH, BEACH AND KITCHEN

[76] Inventors: Daniel W. Bythewood; Alicia Bythewood, both of 2 Faith Ct., Dix Hills, N.Y. 11746

[21] Appl. No.: 912,308

[22] Filed: Jul. 13, 1992

[51] Int. Cl.[5] ..... B32B 3/00; B32B 3/02; F16B 5/07

[52] U.S. Cl. ..... 428/33; 428/53; 428/54; 428/58; 428/85; 428/88

[58] Field of Search ..... 428/33, 53, 54, 58, 428/88, 85

[56] References Cited

U.S. PATENT DOCUMENTS

| | | | |
|---|---|---|---|
| 1,158,051 | 10/1915 | Hopkinson | 428/53 |
| 1,622,035 | 3/1927 | Hendel | 428/54 |
| 2,011,058 | 8/1935 | Krase | 428/33 |
| 3,654,051 | 4/1972 | Bieler | 428/53 |
| 3,661,689 | 5/1972 | Spanier | 428/33 |
| 3,665,617 | 5/1972 | Gilbert | 428/33 |
| 3,751,327 | 8/1973 | Hausler | 428/33 |
| 3,857,749 | 12/1974 | Yoshida | 428/33 |
| 4,287,693 | 9/1981 | Collette | 428/33 |
| 4,571,353 | 2/1986 | Gable, Jr. | 428/33 |
| 4,631,765 | 12/1986 | Casey | 428/33 |
| 4,842,905 | 6/1989 | Stech | 428/33 |
| 4,942,072 | 7/1990 | Chung | 428/88 |

FOREIGN PATENT DOCUMENTS

| | | | |
|---|---|---|---|
| 2724381 | 11/1978 | Fed. Rep. of Germany | 428/33 |
| 2214824 | 9/1989 | United Kingdom | 428/33 |

*Primary Examiner*—George F. Lesmes
*Assistant Examiner*—Terrel Morris
*Attorney, Agent, or Firm*—Michael I. Kroll

[57] ABSTRACT

A puzzle towel/mat for bath, beach and kitchen is provided which consists of a plurality of irregularly shaped pieces having interlocking sides to match up with each other, so as to form one complete unit when fitted together. A mechanism is for retaining the interlocking sides of the plurality of irregularly shaped pieces together when matched up with each other, so as to keep the one complete unit together to be utilized.

8 Claims, 2 Drawing Sheets ("FOLD OVER"-VELCRO STRIP)

(MAGNETIC FASTENERS)

(SNAP FASTENERS)

(SPLIT EDGE VELCRO ATTACHMENT)

PUZZLE TOWEL/MAT FOR BATH, BEACH AND KITCHEN

BACKGROUND OF THE INVENTION

1. Field of the Invention

The instant invention relates generally to puzzles and more specifically it relates to a puzzle towel/mat for bath, beach and kitchen.

2. Description of the Prior Art

Numerous puzzles have been provided in prior art that are each adapted to be a toy game or testing device that tests the ingenuity of a person. While these units may be suitable for the particular purpose to which they address, they would not be as suitable for the purposes of the present invention as heretofore described.

SUMMARY OF THE INVENTION

A primary object of the present invention is to provide a puzzle towel/mat for bath, beach and kitchen that will overcome the shortcomings of the prior art devices.

Another object is to provide a puzzle towel/mat for bath, beach and kitchen that will incorporate the best features of a jigsaw puzzle, so that its size can be increased to allow one or more people to use it.

An additional object is to provide a puzzle towel/mat for bath, beach and kitchen, in which various types of fasteners can be utilized to hold the irregularly shaped pieces together to form one complete unit thereof.

A further object is to provide a puzzle towel/mat for bath, beach and kitchen that is simple and easy to use.

A still further object is to provide a puzzle towel/mat for bath, beach and kitchen that is economical in cost to manufacture.

Further objects of the invention will appear as the description proceeds.

To the accomplishment of the above and related objects, this invention may be embodied in the form illustrated in the accompanying drawings, attention being called to the fact, however, that the drawings are illustrative only, and that changes may be made in the specific construction illustrated and described within the scope of the appended claims.

BRIEF DESCRIPTION OF THE DRAWING FIGURES

DETAILED DESCRIPTION OF THE PREFERRED EMBODIMENTS

Figure 1:
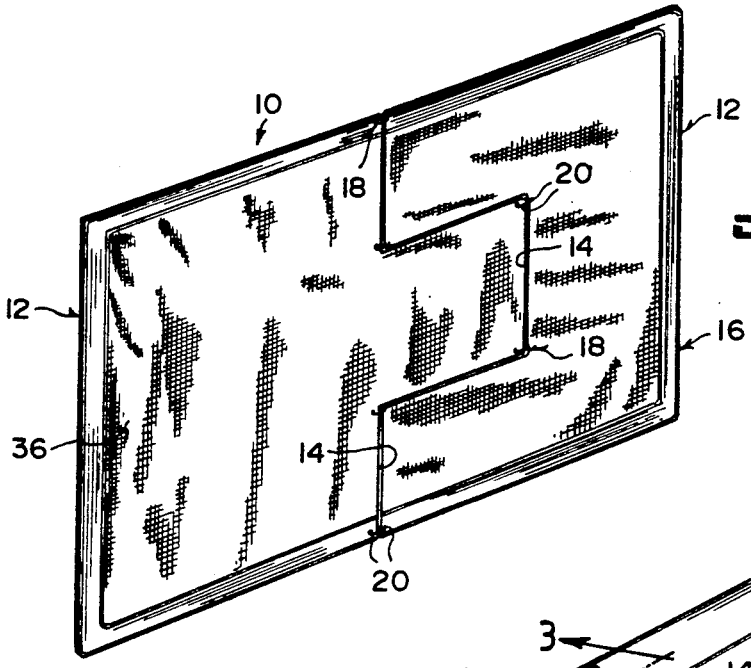
FIG. 1 is a vertical perspective view of a first embodiment of the instant invention, in which the pieces are held together by hook and eye fasteners.

Turning now descriptively to the drawings, in which similar reference characters denote similar elements throughout the several views, the Figures illustrate a puzzle towel/mat 10 for bath, beach and kitchen, which consists of a plurality of irregularly shaped pieces 12 having interlocking sides 14 to match up with each other, so as to form one complete unit 16 when fitted together. A mechanism 18 is for retaining the interlocking sides 14 of the plurality of irregularly shaped pieces 12 together when matched up with each other, so as to keep the one complete unit 16 together to be utilized.

Figure 2:
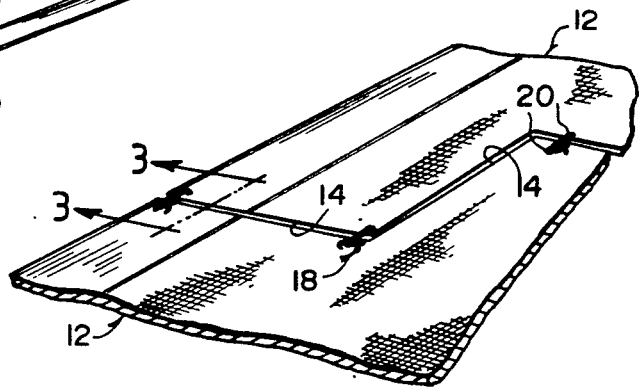
FIG. 2 is a horizontal perspective view of a portion of the first embodiment.
Figure 3:
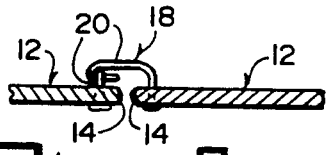
FIG. 3 is a cross sectional view taken along line 3—3 in FIG. 2, showing one hook and eye fastener in greater detail.

The retaining mechanism 18, as shown in FIGS. 1, 2 and 3, includes a plurality of hook and eye fasteners 20 spaced apart along the interlocking sides 14 of the irregularly shaped pieces 12.

Figure 4:
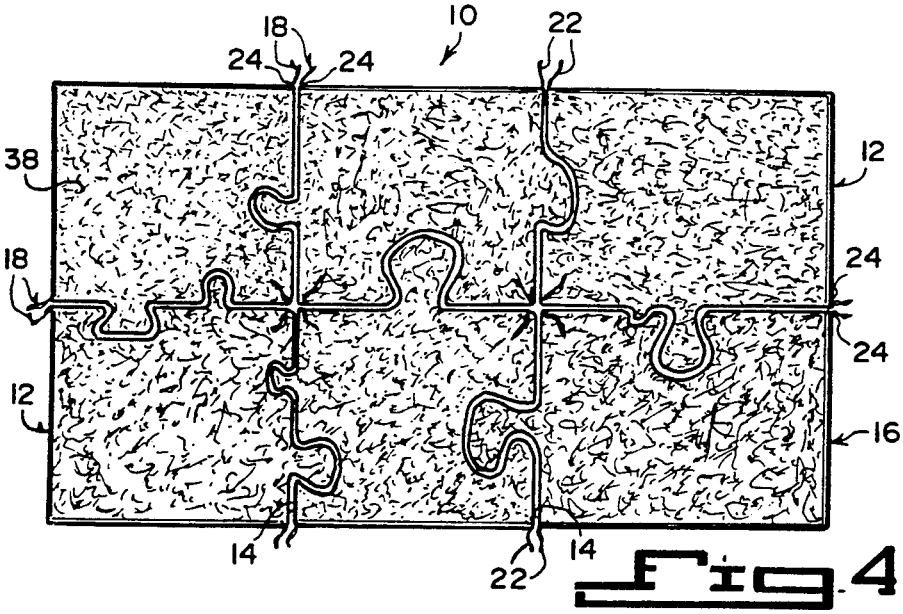
FIG. 4 is a plan view of a second embodiment of the instant invention in which the pieces are held together by tie strings.

The retaining mechanism 18, as shown in FIG. 4, includes a plurality of tie string fasteners 22 spaced apart at the corners 24 of the interlocking sides 14 of the irregularly shaped pieces 12.

Figure 6:
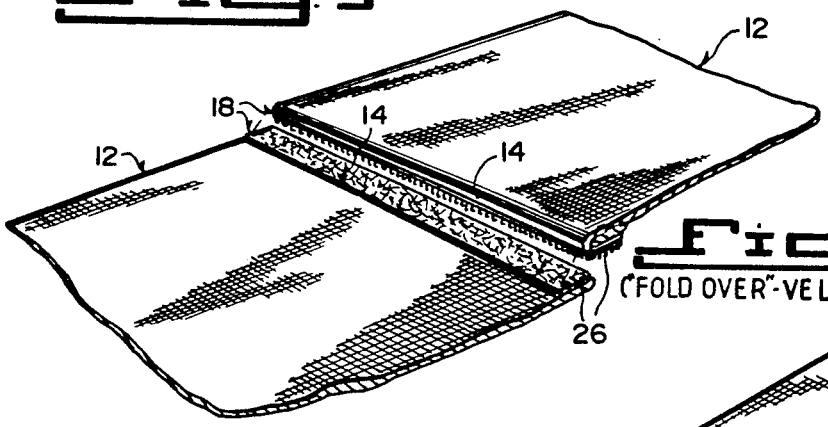
FIG. 6 is a perspective view of a fourth embodiment showing a portion of two pieces held together by a fold over VELCRO strip.

The retaining mechanism 18, as shown in FIG. 6, includes a plurality of fold over VELCRO strip fasteners 26, along the interlocking sides 14 of the irregularly shaped pieces 12.

Figure 7:
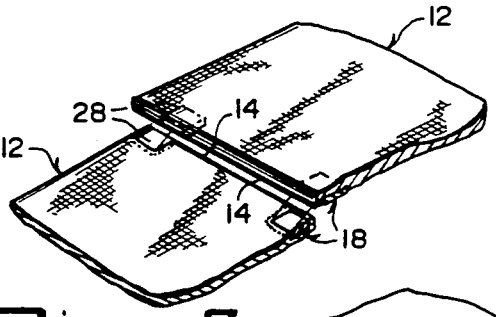
FIG. 7 is a perspective view of a fifth embodiment, showing a portion of two pieces held together by magnetic fasteners.

The retaining mechanism 18, as shown in FIG. 7, includes a plurality of magnetic fasteners 28 spaced apart along the interlocking sides 14 of the irregularly shaped pieces 12.

Figure 8:
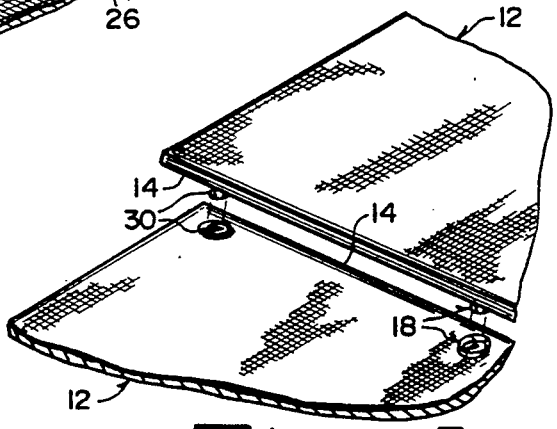
FIG. 8 is a perspective view of a sixth embodiment, showing a portion of two pieces held together by snap fasteners.

The retaining mechanism 18, as shown in FIG. 8, includes a plurality of snap fasteners 30 spaced apart along the interlocking sides 14 of the irregularly shaped pieces 12.

Figure 9:
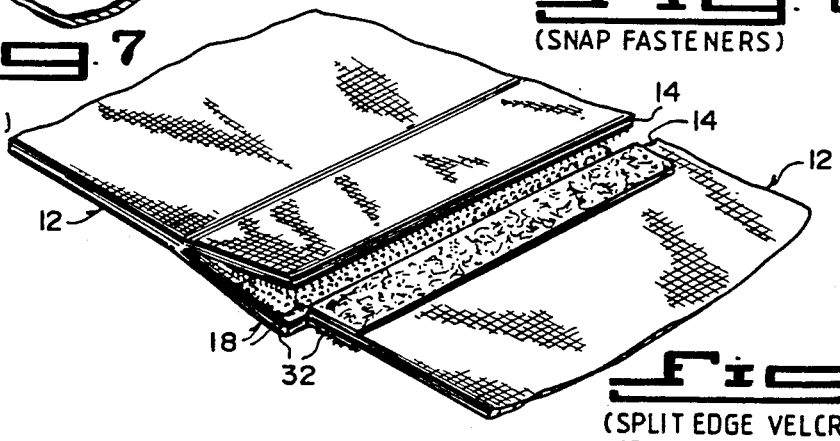
FIG. 9 is a perspective view of a seventh embodiment, showing a portion of two pieces held together by a split edge VELCRO attachment.

The retaining mechanism 18, as shown in FIG. 9, includes a plurality of split edge VELCRO attachment fasteners 32 along the interlocking sides 14 of the irregularly shaped pieces 12.

Figure 5:
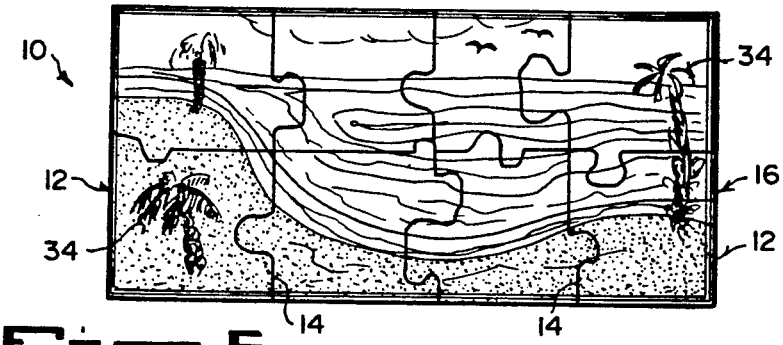
FIG. 5 is a plan view of a third embodiment of the instant invention having a matching portion of a picture on each piece thereof.

In FIG. 5 each irregularly shaped piece 12 includes a matching portion 34 of a picture thereon, so that when said interlocking sides are matched up with each other the picture will be completed.

The irregularly shaped pieces 12 can be fabricated out of soft, heavy woven cloth material 36, so that a person can utilize the one complete unit 16 as a covering to be placed upon the sand of a beach. The irregularly shaped pieces 12 can be fabricated out of absorbent woven cloth material 38, so that a person can utilize the one complete unit 16 for wiping and drying something wet.

The puzzle towel/mat 10 can be made in different sizes, shapes and colors. The irregularly shaped pieces 12 do not necessarily have to fit into all interlocking sides 14, but must fit into just one interlocking side 14. The different irregularly shaped pieces 12 can also be of any size or configuration and also be made out of wood, bamboo, burlap and vinyl. Even though the instant invention was described as a towel/mat 10, it also can be fabricated typically as a hand towel, a pot holder, a bed spread, a face cloth and the like.

LIST OF REFERENCE NUMBERS

10 a puzzle towel/mat
12 irregularly shaped piece
14 interlocking side of 12
16 complete unit
18 retaining mechanism on 14
20 hook and eye fasteners for 18
22 tie string fasteners for 18
24 corner of 12
26 fold over VELCRO strip fasteners for 0/8
28 magnetic fasteners for 18
30 snap fasteners for 18
32 split edge VELCRO attachment fasteners for 18
34 matching portion of a picture on 12
36 soft, heavy woven cloth material for 12
38 absorbent woven cloth material for 12

It will be understood that each of the elements described above, or two or more together may also find a useful application in other types of methods differing from the type described above.

While certain novel features of this invention have been shown and described and are pointed out in the annexed claims, it is not intended to be limited to the details above, since it will be understood that various omissions, modifications, substitutions and changes in the forms and details of the device illustrated and in its operation can be made by those skilled in the art without departing in any way from the spirit of the present invention.

Without further analysis, the foregoing will so fully reveal the gist of the present invention that others can, by applying current knowledge, readily adapt it for various applications without omitting features that, from the standpoint of prior art, fairly constitute essential characteristics of the generic or specific aspects of this invention.

What is claimed is new and desired to be protected by Letters Patent is set forth in the appended claims:

1. A beach towel comprising:

a) a plurality of irregularly shaped pieces having interlocking sides to match up with each other to form one complete regularly shaped unit, said irregularly shaped pieces being fabricated out of soft, heavy woven cloth material; and b) means for retaining said interlocking sides of said plurality of irregularly shaped pieces together when matched up with each other, so as to keep said one complete regularly shaped unit together for use, wherein each said irregularly shaped piece includes a matching portion of a picture thereon, so that when said interlocking sides are matched up with each other the picture will be completed.

2. A beach towel as recited in claim 1, wherein said retaining means includes a plurality of hook and eye fasteners, spaced apart along the interlocking sides of said irregularly shaped pieces.

3. A beach towel as recited in claim 1, wherein said retaining means includes a plurality of tie string fasteners spaced apart at the corners of the interlocking sides of said irregularly shaped pieces.

4. A beach towel as recited in claim 1, wherein said retaining means includes a plurality of fold over VELCRO strip fasteners along said interlocking sides of said irregularly shaped pieces.

5. A beach towel as recited in claim 1, wherein said retaining means includes a plurality of magnetic fasteners spaced apart along said interlocking sides of said irregularly shaped pieces.

6. A beach towel as recited in claim 1, wherein said retaining means includes a plurality of snap fasteners spaced apart along said interlocking sides of said irregularly shaped pieces.

7. A beach towel as recited in claim 1, wherein said retaining means includes a plurality of split edge VELCRO attachment fasteners along said interlocking sides of said irregularly shaped pieces.

8. A beach towel comprising:

a) a plurality of isolated irregularly shaped pieces having complementary interlocking sides to match up with each other to form one complete regularly shaped unit, said irregularly shaped pieces being fabricated from absorbent woven cloth; and b) means for retaining said interlocking sides of said plurality of irregularly shaped pieces together when matched up with each other, so as to hold said one complete regularly shaped unit together for use as a towel, wherein each said irregularly shaped piece includes a matching portion of a picture thereon, so that when said interlocking sides are matched up with each other the picture will be completed.

* * * * *